United States Patent [19]

Birke et al.

[11] 3,984,198

[45] Oct. 5, 1976

[54] DEVICE FOR THE IMPREGNATION AND DRYING OF TEXTILE MATERIAL

[75] Inventors: Walter Birke; Hans-Ulrich von der Eltz; Franz Schön, all of Frankfurt am Main, Germany

[73] Assignee: Hoechst Aktiengesellschaft, Frankfurt am Main, Germany

[22] Filed: Oct. 24, 1974

[21] Appl. No.: 517,765

Related U.S. Application Data

[62] Division of Ser. No. 302,853, Nov. 1, 1972, Pat. No. 3,909,196.

[30] Foreign Application Priority Data

| | | |
|---|---|---|
| Mar. 25, 1972 | Germany | 2214714 |
| Feb. 23, 1972 | Germany | 2246760 |
| Sept. 23, 1972 | Germany | 2246781 |
| Sept. 23, 1972 | Germany | 2246889 |

[52] U.S. Cl. ..... 432/59; 432/8; 432/72; 34/108; 34/115

[51] Int. Cl.[2] ..... D06C 7/04; F27B 9/28

[58] Field of Search ..... 432/8, 59, 72, 227, 432/228, 230, 60; 34/115, 108, 109; 18/47

[56] References Cited

UNITED STATES PATENTS

| | | | |
|---|---|---|---|
| 1,947,547 | 2/1934 | Fruth | 118/47 |
| 2,608,499 | 8/1952 | Straka | 118/47 |
| 3,130,961 | 4/1964 | Verner et al. | 432/72 |
| 3,377,056 | 4/1968 | Boye | 432/60 |
| 3,476,367 | 11/1969 | Fleissner | 34/115 |
| 3,542,501 | 11/1970 | Jones | 431/258 |
| 3,554,502 | 1/1971 | Rye | 432/8 |
| 3,590,495 | 7/1971 | Tyson | 432/8 |
| 3,608,340 | 9/1971 | Fleissner | 34/115 |
| 3,635,748 | 1/1972 | Peoples | 118/47 |
| 3,739,483 | 6/1973 | Meier-Windhorst | 34/115 |
| 3,744,963 | 7/1973 | Flynn | 432/59 |
| 3,811,988 | 5/1974 | Fleissner | 34/115 |
| 3,827,854 | 8/1974 | Gildersleeve | 432/8 |
| 3,889,325 | 6/1975 | Fleissner | 34/115 |

*Primary Examiner*—John J. Camby
*Assistant Examiner*—Henry C. Yuen
*Attorney, Agent, or Firm*—Curtis, Morris & Safford

[57] ABSTRACT

An apparatus for impregnating and drying a material containing an inflammable organic liquid by igniting and burning the liquid from the material, consisting of an impregnating means, an enclosed burning chamber having at one end an inlet for the material to be dried, a combustion air inlet and an ignition means for igniting the inflammable organic liquid and having at an other end transport means for drawing the material through the chamber, an outlet means for hot combustion gases and an outlet means for dried material.

34 Claims, 5 Drawing Figures

4
1
12
12
12
12
12
28
3
2
7
29
3
10
27
27
10
9
9
5
5

4
1
13
13a
12
14
28
3a
3
10a
2
7
29
10
27
9
5
24
23
22

DEVICE FOR THE IMPREGNATION AND DRYING OF TEXTILE MATERIAL

This is a division, of application Ser. No. 302,853, filed Nov. 1, 1972, now U.S. Pat. No. 3,909,196.

Textile materials of the most various kinds of fibers can be impregnated from water or organic solvents according to known methods. In these impregnation processes, the textiles are nippadded, padded or sprayed with a solution or dispersion of the substance to be applied onto the fabric. After the impregnation, the material is generally dried and, depending on the substance applied, further treated. In all these processes, it is necessary to remove the liquid remaining on the textiles from the impregnation bath during drying by the supply of energy.

The present invention relates to a process for the impregnation and subsequent drying of textile material, wherein the material is treated with an impregnating bath containing an inflammable organic liquid and wherein the material is dried by burning off this liquid.

As inflammable organic liquids, there may be used in the process of the invention all inflammable water-soluble or watermiscible and, in connection with emulsifiers, water-insoluble liquids; however, the safety reasons, those liquids are not suitable which have too low ignition points, have too strong an evolution of heat during burning off and have too low evaporation values. Particularly suitable are lower aliphatic alcohols, preferably those containing 1 to 3 carbon atoms, especially methanol, furthermore cyclic ethers, in particular dioxane. The mentioned solvents are used alone or in admixture with water. It is also possible to use small amounts of such organic solvents which develop strong heat during burning off, especially when the process is carried out with impregnating baths which contain high proportions of water. Particularly suitable are impregnating baths which contain 10 to 90% by volume of alcohol and 90 to 10% by volume of water, preferably 30 to 80% by volume of methanol. The addition of water permits control of the speed of the burning off process. In this manner, an optimal mixture can be determined for each fibrous material which prevents inflammation of the fibrous material during the burning off process.

The process of the invention is carried out by padding, spraying or nip-padding the material in the usual manner with an impregnating bath which contains, in addition to the substances to be applied onto the fabric, different amounts of one or more inflammable organic liquids. The impregnating bath may furthermore contain chemicals and auxiliary agents such as dispersing agents, emulsifiers, dyestuff solvents, wetting agents, thickening agents, fiber swelling agents, dyeing accelerators, and so on. The quantity of inflammable organic liquid added can vary within wide limits and depends on the textile material to be treated and on the nature of the substance to be applied onto the fiber.

The temperature used during the treatment of the textile material with the impregnating bath has practically no influence on the result. In general, the treatment is carried out at temperatures in the range of about 10° and 60° C, preferably at room temperature.

According to a variant of the process of the invention, the impregnating bath and the material to be treated are cooled, for safety reasons, during the application process to temperatures such that the impregnated material has a temperature below the ignition point of the liquid used. Depending on the machine speed selected, temperatures of the material of about 1° to 40° C, preferably 1° to 15° C, below the respective ignition point of the impregnating bath are sufficient.

In special finishing processes which require that the material remain in contact with the impregnating bath for a prolonged period of time, the conditions are so selected that after the dwelling the temperature required with a view to the ignition point is still maintained.

After impregnation and/or dwelling, the material is dried in such a manner that the imflammable organic solvent is ignited by a suitable ignition device and burned off completely. For safety reasons, it is advisable to use such mixtures of water and inflammable organic solvents whose ignition points are above room temperature. In any case it is necessary that the ignition device be so constructed that it supplies at the beginning the energy required for heating up the solvent vapors to temperatures above the ignition point.

According to the invention, it has likewise been found that more advantageous results are obtained in most cases if the burning off process of the liquid on the material is carried out in connection with known drying systems. In special cases, the burning off of the liquid on the material can also be effected on one side by the supply of additional heat, which according to the invention can be realized preferably during passage of the material around a rotating drum.

If the impregnating bath which is already on the material is heated, for example by infrared heating devices to temperatures above the ignition point of the respective solvent used, a single ignition is in general sufficient. The ignition is suitably effected in direct vicinity of the heating device.

In the mode of operation using a rotating drum, this heating of the material may be effected, for example by an oil-heated drum, by infrared irradiation, or by gas jets, or in the case of a preferred drum, by hot air. Additional heating devices along the burn-off area are furthermore of advantage, if the operation is carried out with impregnating baths which contain a high proportion of water. It is thereby possible to adjust the steam to temperatures at which it may be used directly or indirectly for any fixing processes following the drying.

Depending on the special impregnating process, the dried material is then further treated. For example, in a dyeing process, the dyestuff is fixed in the usual manner, either by contact heat, by a hot air treatment, by a dwelling process, by steaming or by other processes. In processes in which the dyestuff fixation is effected by a heat treatment, the heat set free during the burning off can be utilized therfor in the burning-off equipment itself or in a following fixing plant. The same procedure may also be applied in impregnating processes such, for example as processes for rendering materials flameproof or providing them with a high quality finish, in which the heat formed during the burning off may be used for the hardening of the precondensates applied onto the fabrics.

The process of the invention is suitable for such impregnating processes in which one or several substances are applied onto the fabric. Such substances are, for example the dyestuffs, sizing agents, optical brighteners, finishing agents and other substances usually employed in the textile industry. As dyestuffs, practically all dyestuffs of any class and any form of application may be used in the process of the invention, independently on whether the dyestuffs are soluble or not in the inflammable liquid used. If dyestuff solutions are used, the dyestuffs employed need not be prepared in the commerical form, but can be used without previous finish treatment of the dyestuff.

The process can be applied practically to all kinds of fibers of motive or synthetic origin, as well as to all fiber mixtures. The textile materials may be present in processing states suitable for a continuous method of operation, for example as cables, worsted, filaments, yarns, fabrics, knitted fabrics or non-woven fabrics.

The burning off produces a more or less strong singeing effect which is dependent on the inflammable solvent and on the water content of the treating baths and which in many cases makes unnecessary a usual singeing treatment.

The advantage of the process of the invention resides in the fact that the textile material can be dried, after the impregnating processes, in simple manner and optionally without additional energy, whereby the products are distributed essentially more uniformly on the textile material than according to the conventional processes. This applies especially to strongly migrating dyestuffs which yield considerably more level dyeings when treated according to the process of the invention. It was surprising that the fibers are not damaged by this treatment and that the textile-technological character, for example the handle is fully maintained. A further advantage of the process of the invention is that, if methanol is used, no substances are formed by the burning off which would contaminate the air or the water. Moreover, the use of methanol/water mixtures offers the advantage that the speed of the burning off can be controlled in easy manner by modification of the mixing proportion and, on the other hand, that in this manner the natural moisture of the fiber can be better regulated. The present invention will be more fully understood from the description given herein below and the accompanying drawings which are briefly described as follows:

Figure 3:
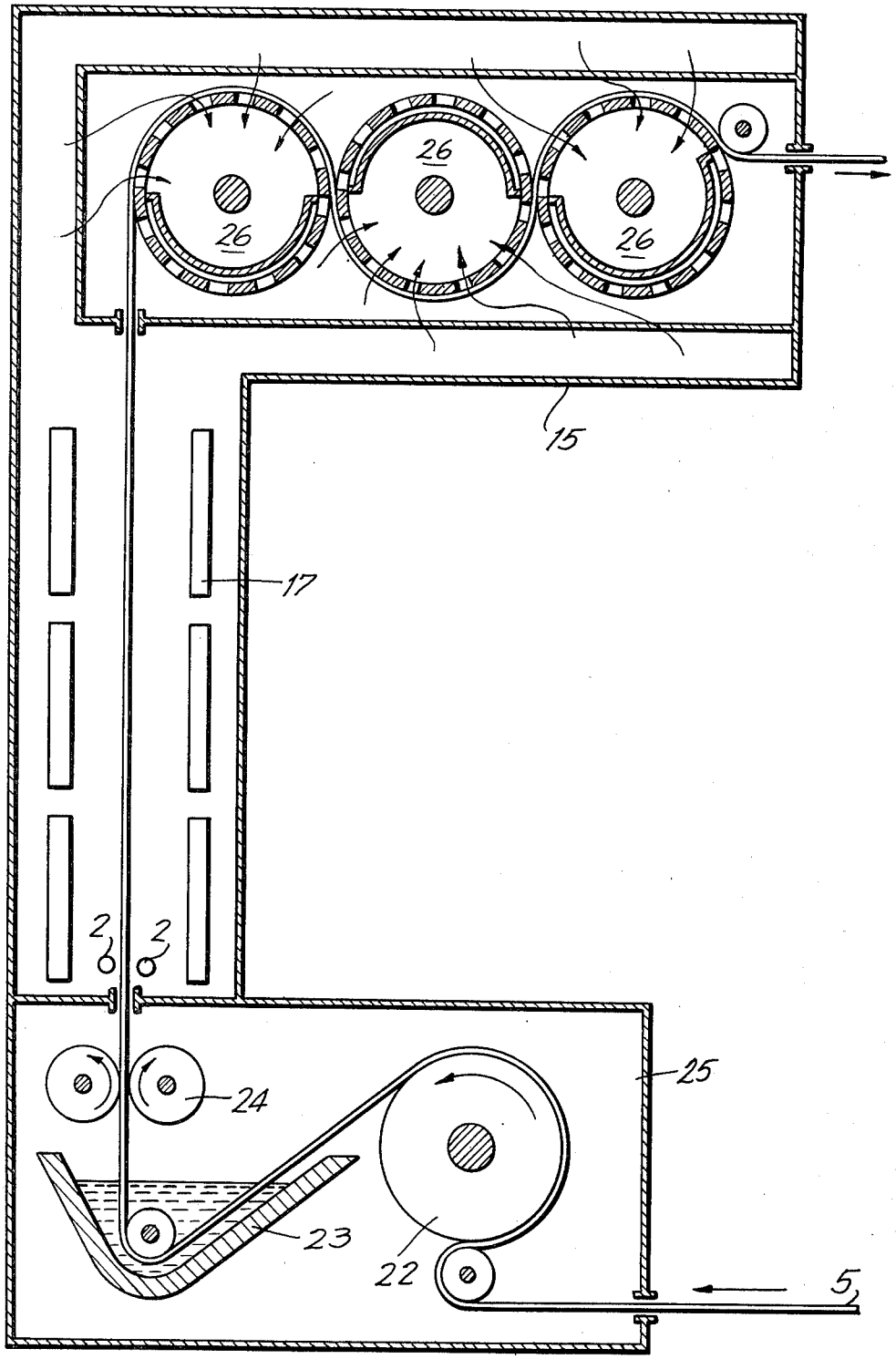

FIG. 3 is a schematic illustration of a vertical cross-section of the apparatus showing a burning chamber, material inlet means at the bottom thereof, material impregnating and cooling means disposed outside and ahead of the material inlet means and material outlet means at the top of the chamber and separated from said buring chamber but disposed within said apparatus and in combination therewith a second treating chamber.

Figure 4:
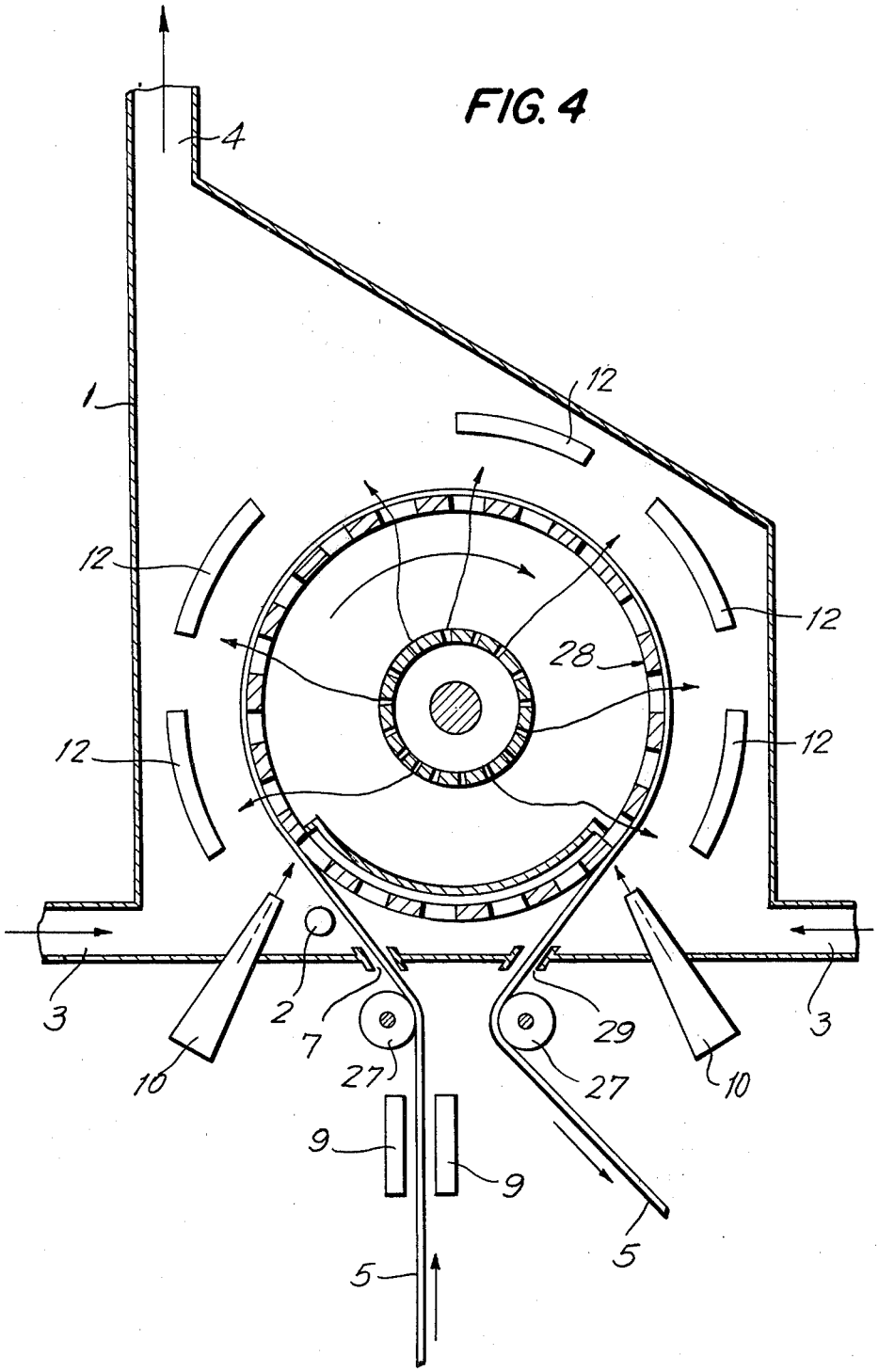

FIG. 4 is a schematic illustration of a vertical cross-section of the apparatus showing a buring chamber, material inlet means and combustion air inlet means at the bottom of the chamber, a perforated drum transport means disposed within the chamber, combustion gas inlet means in the top of the chamber and material outlet means in the bottom of the chamber.

Figure 5:
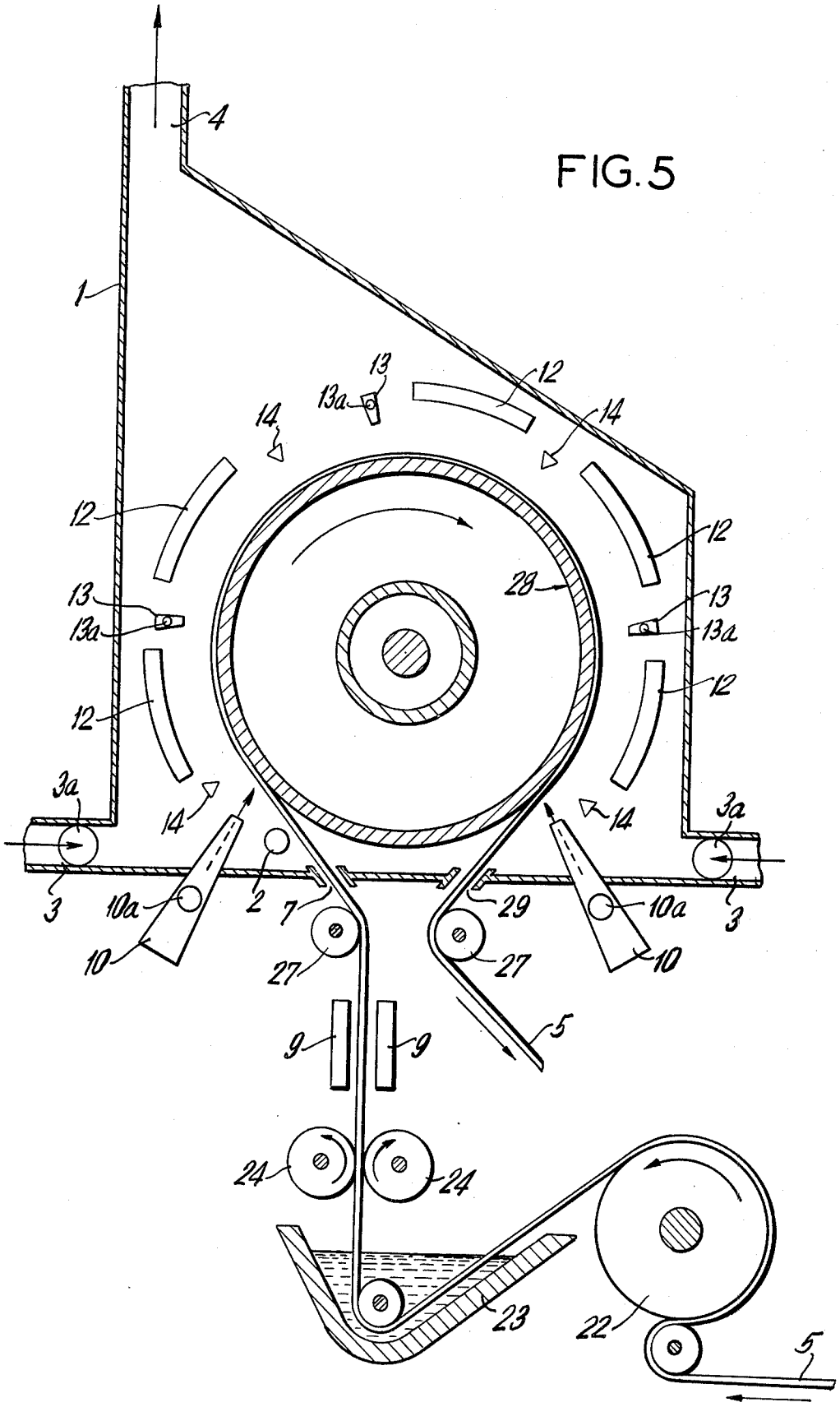

FIG. 5 is a schematic illustration of a vertical cross-section of the apparatus showing a burning chamber, material inlet means and combustion air inlet means in the bottom of the chamber, a closed drum transport means disposed within the chamber, impregnating and cooling means disposed outside and ahead of the inlet means, combustionn gas outlet means in the top of the chamber and material outlet means in the bottom of the chamber.

A drying equipment which is suitable for realizing the process of the invention is shown, by way of example, in the annexed drawings. In general, and with reference to said drawings, such a drying device comprises a burning off chamber (1) with inlet and outlet and transporting means for the material during passage through the device, and igniting element (2) and and means for the supply of air (3) and for the discharge of the exhaust gases and of the steam (4), as shown in the schematical drawing FIG. 1. The material (5) may enter into the burning off chamber either from the top of from below. In addition, certain safety means must be provided.

If the goods enter the chamber from below, the ignition device must be so constructed as to ensure continuous ignition of the solvent entering anew with the goods the burn-off chamber. If the goods are passed in inversed sense, the ignition device shall ignite the solvent vapors only once, The burning off then proceeds automatically, since the goods are running into the rising flame. In order to obtain uniform drying of the web of the fabric, one ignition device each on each side of the web of the fabric or on both edges must be present. As igniting devices, for example gas flames or electric ignition elements may be used.

At the top side, the burning off chamber is suitably sealed, for reasons of safety, by a pair of rolls (6). At the lower part of the chamber, an inlet or outlet slot (7) is in general sufficient. The metal rolls as well as the inlet or discharge slot may be provided with sliding bands (8) or other non-flammable sealings. The height of the chamber depends on the speed of passage of the goods and on the nature and quantity of the inflammable liquid used. In practice, the burning off chamber will have a height of from 0.5 to 10 m, preferably 1 to 5 m. The burning off chamber may also be constructed in a totally or partly open form, in which the lateral walls are completely or partially omitted.

The top part of the chamber is provided with discharge openings (4) for the hot exhaust gases which can be passed directly into a fixed chamber arranged beside the burning off chamber. The air required for the burning off is supplied from outside through corresponding tubes (3). For reasons of safety, a ventilating device (9) can be arranged before the burning off chamber which removes by aspiration any solvent vapors which are released from the moist material before it enters the chamber.

Another safety device or a device for stopping the machine consists of nozzles (10) which are directed, in the case of an open or semi-open construction, to the burning off area and, which, in the case of a closed construction, are placed within the burning off chamber or before the inlet aperture and optionally before the outlet aperture and through which nitrogen or another not inflammable gas can be passed. If these nozzles are opened, the supply of oxygen or air should simultaneously be stopped.

Figure 1:
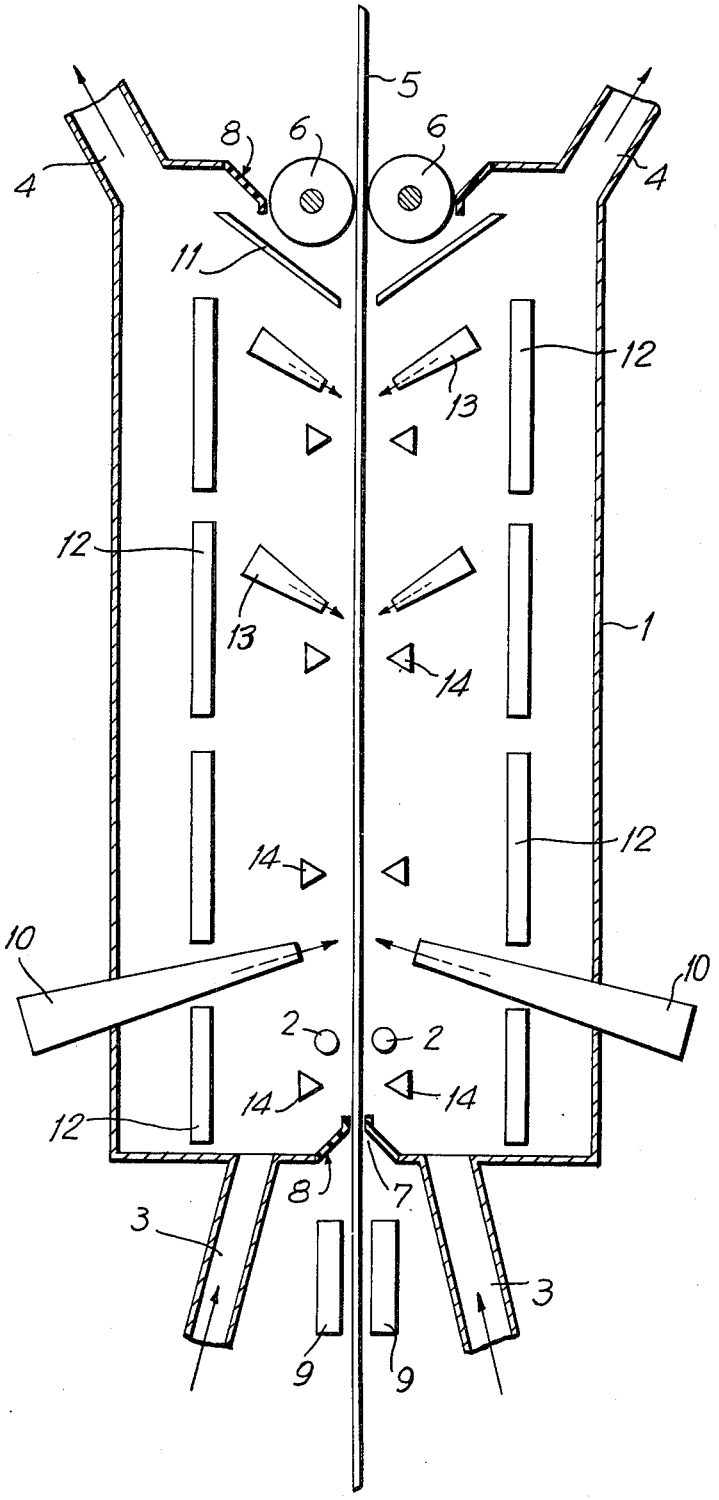
FIG. 1 is a schematic illustration of a vertical cross-section of the apparatus showing a buring chamber, combustion air and material inlet means at the bottom thereof, vacuum means disposed outside and ahead of the material inlet means and combustion gas and material outlet means at the top of the chamber.
Figure 2:
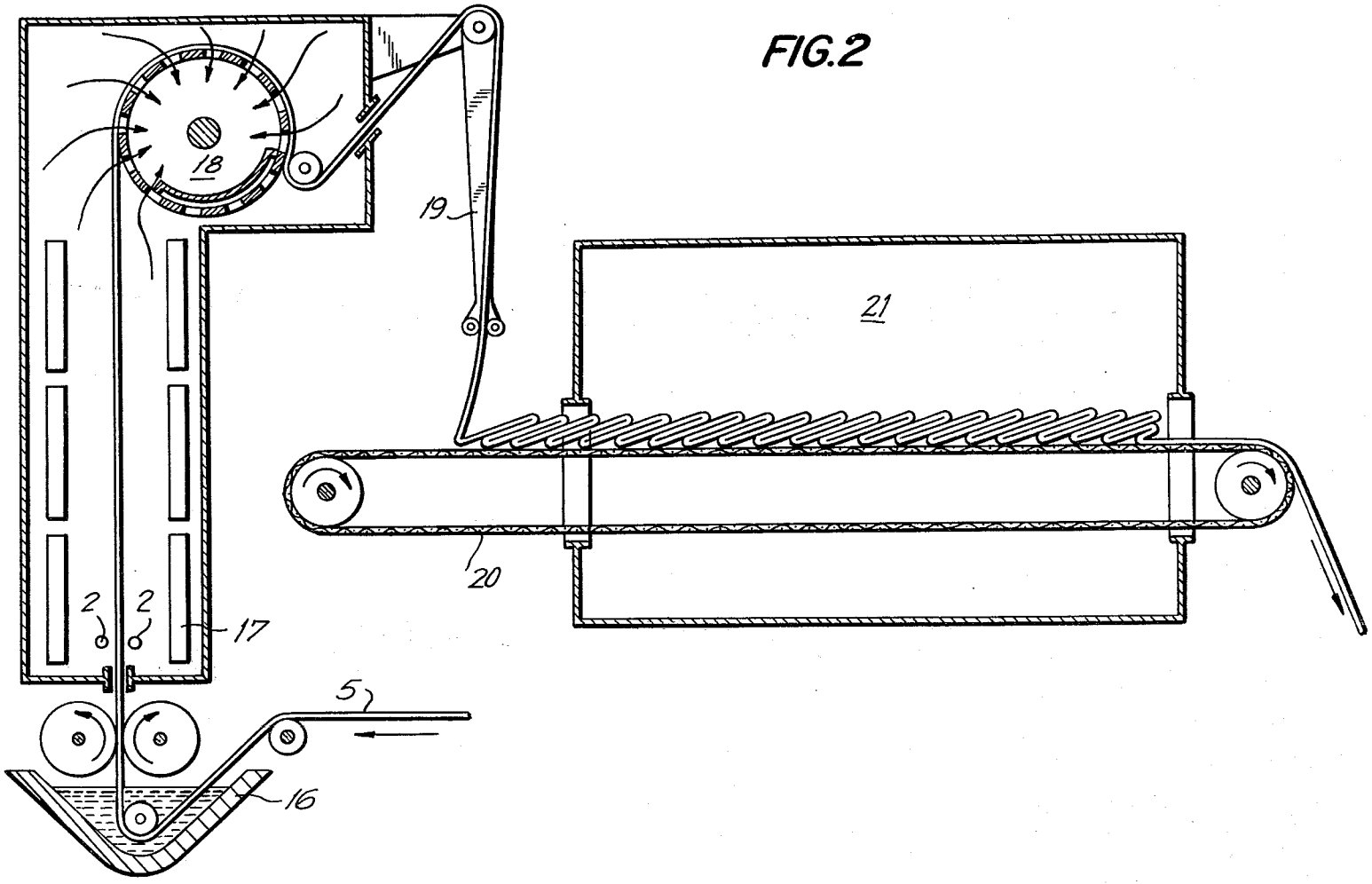
FIG. 2 is a schematic illustration of a vertical cross-section of the apparatus showing a burning chamber, material inlet means at the bottom thereof, material impregnating and cooling means disposed outside and ahead of the material inlet means, material outlet means at the top of the chamber and in combination therewith a second chamber for treating and finishing the material.

In the equipment shown by FIG. 1, the goods can also be passed from the top downwards. In this case, the igniting device (2), the means for the supply of air (3) and the suction device (9) have to arrange at the upper part of the burn-off chamber.

The elements required for transporting the fabric are suitably protected against too strong heating by a heat shield (11). Furthermore, they are adjustable in height, whereby the drying distance can be varied in length. Along the fabric web transported within the drying chamber, there are arranged on both sides heating devices (12) which heat up the inflammable liquid on the fabric to above its ignition point and, on the other hand, promotes the evaporation of the inflammable liquid or of the water. In addition thereto, they support the heating up of the exhaust gases and of the steam so that these can be used directly or indirectly for fixing processes. Along the drying distance, there are arranged conrol devices (14) for the drying, the regulation of the speed of the fabric in dependence on the burning-off distance and for the function of the safety devices. The control of the flame is effected, for example by lateral air nozzles (13) which are likewise arranged at both sides of the burning off area and can be turned to either side.

Another safety device consists in cooling elements for the goods to be treated and the impregnating liquor, which are arranged before the inlet of the goods into the chamber. Such elements may comprise, for example a cooling trough with foulard rollers and a cooling drum.

The FIG. II of the drawings illustrates the apparatus according to the present invention in combination with known finishing equipment. This combination consists of an impregnation bath for a treating agent, such as a dyestuff, containing an inflammable organic liquid together with a pair of squeezing rollers, a burning chamber vertically disposed and including heating means, the inlet for the material and the ignition means are at the lower end and the outlet for the combustion gases and transport means provided by a rotatable drum are at the upper end, and a second heating chamber, for example a steamer, having an inlet and outlet means for the textiles and a continuous conveyor belt for transporting the material through the second chamber. The reference numbers used in FIG. II have the following meanings:

| | |
|---|---|
| 5 | Web of fabric |
| 16 | Foulard, trough, bath |
| 2 | Ignition device |
| 17 | Infrared tunnel, infrared irradiator (burn-off chamber) |
| 18 | Aspiration drum |
| 19 | Docking device |
| 20 | Sieve band, endless running |
| 21 | Steamer |

The FIG. III of the drawings shows cooling means disposed outside of the burning chamber and ahead of the inlet for cooling the inflammable organic liquid to a temperature below its ignition point, which means consist of a cooling drum which is brought into contact with the textile material, and of a liquid cooling bath through which said material passes prior to being fed to the inlet. Behind the burning chamber and separate therefrom is a second heat treating chamber into which the dried material is fed. The heating is provided in the second chamber by hot combustion gases from the first chamber. The second chamber includes, as means for transporting the dried material through the second chamber, perforated drums which are operably associated with drive means causing the drums to rotate and to draw said material from the inlet to the outlet. The reference numbers used in FIG. III have the following meanings:

| | |
|---|---|
| 5 | Web of fabric |
| 22 | Cooling drum |
| 23 | Cooling trough |
| 24 | Foulard squeezing rollers |
| 25 | Padding chamber under slight underpressure(311 to 911 mbar) |
| 2 | Ignition device |
| 17 | Infrared tunnel with infrared irradiators |
| 26 | Sieve drum, at the same time thermosol |
| 15 | Distributor chamber for hot air |

FIG. IV shows a modification of above-described types of the device of the invention, using as transporting means for the goods a perforated rotating drum, wherein combustion air is supplied to only one side of said material, and in which the burning off of the inflammable portions of the impregnating bath is effected from one side. Suction means are provided before the inlet to remove inflammable organic liquid vapors from the material before the material enters the burning chamber. The reference numbers used in FIG. IV have the following meanings:

FIG. IV

| | |
|---|---|
| 1 | Burn-off chamber |
| 2 | Ignition device |
| 3 | Supply of air |
| 4 | Discharge of the exhaust gases and of the steam |
| 5 | Web of fabric |
| 27 | Fabric guide rollers |
| 7 | Inlet slot |
| 28 | Drying drum |
| 9 | Ventilation device |
| 10 | Safety nozzles |
| 12 | Heating devices |
| 29 | Discharge slot |

According to the invention, the drying drum in FIG. IV may be a closed or perforated drum. With a closed drum, hot water, steam or oil which are circulated in the drum may serve for heating up the impregnating liquor on the goods to a temperature above the ignition point. If a perforated drum is used, hot air is blown from one side through the textile material, which has the same effect. The diameter of this drum depends on the drying speed of the textile material.

FIG. 5 of the drawings illusrates an embodiment of the invention in which the material to be dried is fed into a burning chamber through an inlet in an end wall is removed from the burning chamber through another inlet in the same end wall, and shows transport means which comprise a closed drum rotatably mounted in the burning chamber. The figure also shows means 3 and **3*a* and 13 and 13*a* for supplying and closing off the supply of combustion air and means 10 and 10*a* for supplying and closing off the supply of a non-combustible gas to extinguish burning organic liquid. Control means 14 are shown mounted in the burning chamber. In addition, suction means 9 and impregnating means 23 and organic liquid 23*a* and cooling means 22** are shown disposed approximate to and outside of the inlet to the burning chamber.

The burning off process can be controlled by photocells, thermosensors or other control devices; thus, such control devices which are placed below or above the ignition device can trigger, for example in the case of a flame running backwards, the above-described safety devices and/or optionally regulate the speed of the machine and influence the ignition device.

The following Examples illustrate the invention:

EXAMPLE 1:

15 g of the commerical dyestuff of the formula

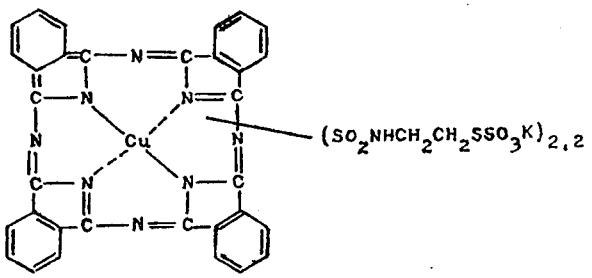

were dissolved in 200 ml of water at about 80° C and then diluted with 800 ml of methanol. A cotton twill was padded with this bath at about 20° C and dried in a suitable plant by burning off the inflammable solvent that had remained behind on the material. A blue dyeing with impeccable aspect was obtained, whereas a dyeing prepared from an aqueous bath and dried on a conventional drying apparatus showed strong signs of migration.

The dyeing was then further treated according to a method usual for this class of dyestuffs (cold over-padding with a bath, which contained 20 g/l of concentrated sodium sulfide, 10 ml/l of 33 % formaldehyde and 200 g/l of sodium chloride, air passage for 30 seconds, rinsing cold and hot, hot soaping for 10 minutes with 0,3 g/l of a non-ionogonie detergent on the basis of an alkylphenol-polyglyeol ether and 0.5 g/l of soda, rinsing and drying).

EXAMPLE 2:

20 g of a mixture of equal parts of the two commercial dyestuffs of the formulae

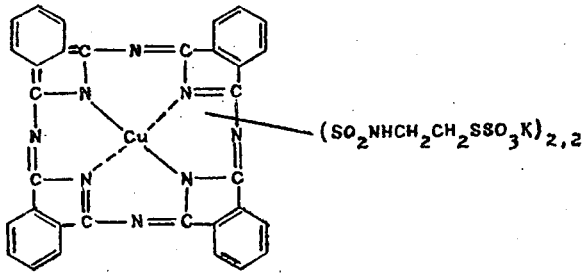

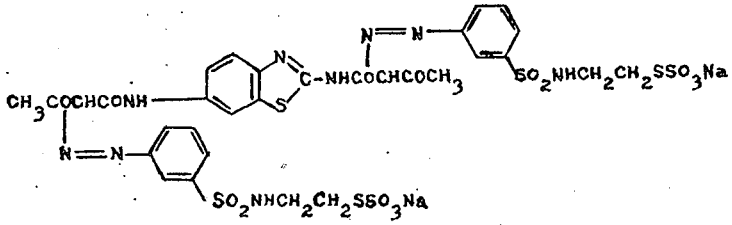

were applied onto a cotton poplin from a mixture of 70% by volume and 30% by volume of water. The method used corresponds to that described in Example 1 with two modification that the two last rinsing processes after soaping were carried out in methanol. The fabric was then squeezed and dried, in the same manner as after by dyestuff impregnation, by burning off the inflammable liquid that remained on the fiber. A green dyeing was obtained; neither after the first drying nor after completion of the dyeing there could be stated any unlevelness or dyestuff migration. In contradistinction thereto, a dyeing produced from an aqueous bath and dried on a conventional drying apparatus exhibited these disadvantageous aspects to a high degree.

EXAMPLE 3:

2 of the dyestuff of the formula

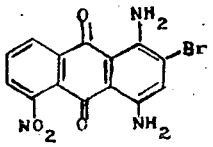

were dissolved in 1 liter of methanol. With this bath, a fabric of polyester fibers was padded on a foulard about 15° C and dried by burning off the alcohol in a suitable apparatus.

In a second experiment, the same dyestuff was used at the same concentration, this time however in a commercial form provided with filling agents, in a mixture of 80% by volume of methanol and 20% by volume of water.

Both blue dyeings showed no migration of the dyestuff and a very good appearance of the fabric. In contradistinction thereto, a dyeing prepared from an aqueous dispersion and which had been dried on a conventional drying apparatus showed distinct migration of the dyestuff and a strip-like appearance which is typical for the fabric used.

All the dyeings were then further treated in the usual manner (fixation for 1 minute at 200° to 210° C with hot air).

EXAMPLE 4:

20 g of a mixture of commerical dyestuffs of the following formulae and in the indicated mixing proportion

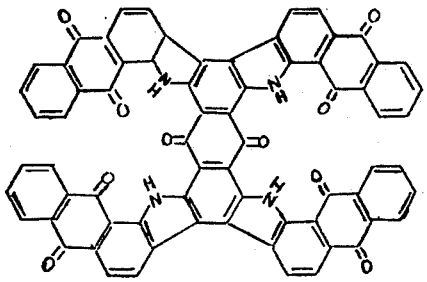

65 %

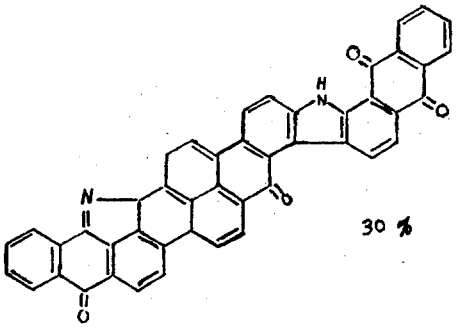

30 %

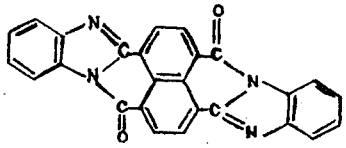

5 % were dispersed in 1 liter of a mixture of 60 % by volume of methanol and 40 % by volume of water at about a 30° C. A cotton fabric (linnen structure) was padded on a foulard with this bath and dried in a suitable apparatus by burning off the inflammable liquid on the fabric. A khaki coloured fabric was obtained which, with regard to levelness and depth of colour, exhibited a very good outer appearance which was also maintained after the further treatment of the dyeing according to one of the usual methods (for example, over-padding with an alkali, reduction agent and electrolyte containing bath, subsequentsteaming, oxydation, etc.).

EXAMPLE 5:

3 g each of the dyestuff C.I. 49 705 (Solvent Blue 22) were dissolved in each time 1 liter of the following solvents at about 20° C: methanol, isopropanol, perchloroethylene methylene chloride.

Fabrics of polyester staple fibers and of polyamide-6 staple fibers were then padded on a foulard with these dyestuff solutions and dried. Drying was effected in the case of the alcohols used in a suitable apparatus by burning off and in the case of the chlorimated hydrocarbons in a conventional drying apparatus.

The blue dyeings dried by burning off showed a completely uniform appearance, whereas the two other dyeings produced from perchloroethylene and methylene chloride showed strong dyestuff migration and a strong double-sidedness. The dyeings were subsequently further treated according to one of the usual methods (for example, thermofixation).

EXAMPLE 6:

2 g each of the blue dyestuff of the formula

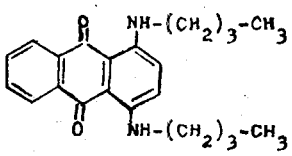

were dissolved in each time 1 liter of the following liquids:

methanol, isopropanol, a mixture of 90 % by volume of methanol and 10% by volume of water, a mixture of 60 % by volume of methanol and 40 % by volume of isopropanol, perchloroethylene and methylene chloride.

The further mode of operation corresponded to that described in Example 5. The results obtained were similar to those obtained in Example 5.

EXAMPLE 7:

5 g of the dyestuff C.I. 62125 (Acid Blue 40) were dissolved in 1 liter of a mixture of 80% by volume of methanol and 20 % by volume of water at about 40° C. After cooling to room temperature, a fabric of polyamide 6,6 staple fibers was impregnated with this solution on a foulard and subsequently dried on a suitable apparatus by burning off the inflammable liquide that remained on the goods. An impeccable uniform blue dyeing was obtained which was then further treated according to a usual method (for example, by streaming).

Similar results were obtained on a wool gabardine and on a mixed fabric of wool and polyamide-6 fibers, in which, especially in the dyeing of wool, the frosting effect which apears in most cases when dyeing with the dyestuff according to conventional methods could not be stated after the drying method of the invention.

Similar results could be obtained on the described 3 types of fabrics with the following dyestuffs:

a. 10g/l of the blue dyestuff C.I. 62 155 (Acid Blue 111)

b. 8g/l of the yellow dyestuff of the formula

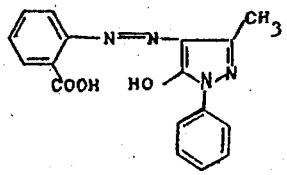

in the form of the 1:2 chromium comples, e. 6 g/l of the red dyestuff of the formula

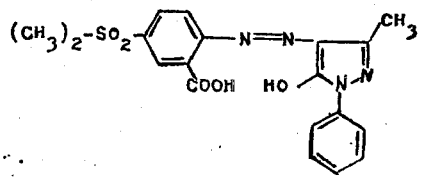

in the form of the 1:2 chromium complex, d. a mixture of 10 g/l of the yellow dyestuff C.I. 19 025 (Acid Yellow 41) and 4 g/l of the red dyestuff C.I. 17 070 (Acid Red 42).

EXAMPLE 8:

5 g of the dyestuff C.I. 18 852 (Reactive Yellow 17) in the form of a commercial preparation were dissolved in 250 ml of water at about 60° C.

Furthermore, 3 g of the dyestuff of the formula

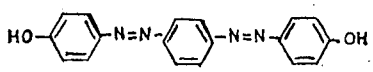

were dissolved in 750 ml of methanol. Both solutions were mixed. As alkali for the fixation of the reactive dyestuff, 8 g of soda were added.

A mixed fabric of 67 % of polyester fibers and 33 % of cotton was padded with this bath on a foulard and dried, as described in the foregoing Examples, by burning off. A fabric was obtained which showed a completely uniform appearance.

A further treatment of the yellow dyeing on both fiber components was effected by a hot air treatment at about 190° C for 1 minute. The dye fabric was then rinsed cold and hot with water, then soaped hot for 10 minutes with an aqueous bath which contained, per liter, 1 of a conventional soaping agent on the basis of a fatty acid methyl tauride, and finally rinsed at first with water and subsequently with methanol. The methanol-wet fabric was squeezed on a foulard with a squeezing effect of 40 % (parts by weight, referred to the weight of the fabric) and directly thereafter sprayed to a layer of 30 % (likewise parts be weight, referred to the weight of the goods) with a liquor which contained 100 g of a finishing agent in the form of a commerial polyvinyl acetate dispersion containing a softener, per liter of a mixture of 80 % by volume of water and 20 % by volume of methanol.

The fabric was then dried, as in the preceding dyestuff drying, in a suitable apparatus by burning off the inflammable solvents on the goods. The final treatment was carried out by calandering at about 60° C.

EXAMPLE 9:

A fabric of polyester staple fibers was padded on a foulard with a bath which contained, per liter of a mixture of 65 % of 65% by volume of methanol and 35 % by volume of water, 25 g of an optical brightener on the basis of benzoxazole present in the commerical form of an aqueous dispersion. The padded fabric was dried, as described in the preceding Examples, by burning off. The further treatment was effected by a conventional heat fixation at 200° C for 30 seconds.

EXAMPLE 10:

A dyed mixed fabric of 67% of polyester fibers and 33% of cotton was padded on a foulard with a bath which contained, per liter of a mixture of 60 % by volume of methanol and 40% by volume of water, 80% of a finishing agent on the basis of a commercial polyvinyl acetate dispersion containing a softener. The fabric was then dried in a suitable apparatus by burning off the inflammable liquid remaining of the fabric and subsequently calandered. A finished fabric which was fast to washing was obtained.

EXAMPLE 11:

A water or alcohol soluble finishing agent on the basis of a copolymer was applied a) from water according to the conventional method, b) from methanol according to the method described in Example 10, onto a staple fiber lining. There were obtained similar results according to both methods with regard to influence on the handle and improvement of the non-slip properties.

EXAMPLE 12:

120 g of a commerical high quality finishing agent on the basis of a carbamate reactant resin were dissolved together with 25 g of crystallized magnesium chloride in a mixture of 70% by volume of methanol and 30 % by volume of water. Unbleached cotton poplin was padded with this bath on a foulard and dried by burning off as described above. The final treatment was carried out by the usual condensation at about 100° C for 3 minutes. A peplin with an excellent wash-and-wear finish and a soft handle was obtained.

Excellent results with simultaneous optical brightening effects were also obtained when adding to the above-described impregnating bath 4 g of a commercial optical brightener for cellulose fibers on the basis of a stilbene derivative and carrying out the condensation or thermosolation at about 190° C for about 20 seconds.

EXAMPLE 13:

Fabrics of the following fibers: polyester, polyamide, polyacrylonitrile, polyvinyl chloride, polypropylene, cellulose triacetate and cellulose 2 ½ acetate were impregnated by padding with a solution of 60 g/l of a commercial antistatic agent on the basis of a polycondensation product containing reactive groups and 3 g/l of calc. soda in a mixture of 70 % by volume of methanol and 30 % by volume of water. The drying of the fabrics was carried out as described in the preceding Examples by burning off. The fixation of the antistatic agent to render it fast to washing was effected by treatment with dry hot air at about 120° C for 90 seconds. In all cases, there were obtained similar results as those obtained according to a conventional method of aqueous application.

EXAMPLE 14:

20 g of the dyestuff Vat Orange 7 (C.I. 71 105) were dispersed in 600 ml of water and made up with dioxane (diethylene dioxde) to a volume of 1 liter. A cotton twill was padded on a foulard with this bath and dried in a suitable apparatus by burning off the inflammable liquid remaining on the fabric. A brilliant orange dyeing showing a completely uniform appearance with regard to levelness and depth of shade was obtained, which has also preserved after the fixation of the dyestuff according to one of the methods used for vat dyestuffs.

EXAMPLE 15:

4 g of the dyestuff Acid Blue 40 (C.I. No. 62 125) were dissolved in 1 liter of a mixture of 80 % by volume of methanol and 20% by volume of water. A fabric of polyamide-6,6 staple fibers was padded on a foulard at about 18° C and dried in a suitable apparatus by burning off the alcohol. The dyestuff was subsequently fixed on the polyamide fabric by a hot air treatment for 1 minute at about 200° C. This was carried out in a chamber directly connected to the burning off chamber and which was heated indirectly by the heat set free by the burning off.

The dyed fabric was further treated at first in the usual manner by rinsing, soaping with an aqueous bath of 0.5 g/l of a non-ionogenic detergent at about 40° C and rinsing with water. After the last rinsing, the fabric was squeezed, rinsed with methanol, squeezed again and dried, as after the impregnation with dyestuff, by burning off the alcohol. A blue dyeing was obtained.

We claim:

1. An apparatus for drying a material containing an inflammable organic liquid by igniting and buring the liquid from the material without damaging the material, comprising a burning chamber having two opposing walls, two lateral walls and two end walls, and having at one end of said chamber one of said end walls having therein an inlet for the material to be dried, and having at the other end of said chamber an outlet for hot combustion gases, combustion air inlet means disposed approximate to the material inlet means disposed outside of the burning chamber and approximate to the material inlet and operably connected to said chamber for providing on the material a burnable organic liquid, ignition means being mounted within said chamber and adjacent to said material inlet for igniting the inflammable organic liquid while on said material, means for maintaining burning of said liquid including said combustion air inlet means, one of the ends of said chamber having an outlet for dried material, transport means for transporting the material through said chamber, said transport means being disposed approximate to said material outlet and being operably connected to said burning chamber.

2. The apparatus of claim 1 wherein suction means are disposed outside of the burning chamber and adjacent to the material inlet and are operably connected to said burning chamber to remove burnable organic liquid vapors from the material before the material enters the burning chamber.

3. The apparatus of claim 1 including safety means mounted in the burning chamber and disposed approximate to the material and operably connected to the burning chamber for supplying a non-combustible gas capable of extinguishing burning organic liquid.

4. The apparatus of claim 1 wherein the burning chamber is enclosed.

5. The apparatus of claim 1 wherein combustion air is supplied to only one side of said material and burning off the inflammable organic liquid is from one side only.

6. An apparatus for impregnating and drying a fibrous material containing an inflammable organic liquid by igniting and burning the liquid from the material without damaging the material, comprising a burning chamber having two opposite walls, two lateral walls and two end walls, said chamber having at one end of said chamber one of said end walls having therein an inlet for the material to be dried, and having at the other end of said chamber an outlet for hot combustion gases, combustion air inlet means disposed approximate to the material inlet means disposed outside of the burning chamber and approximate to the material inlet and operably connected to said chamber for providing on the material a burnable organic liquid, ignition means being mounted within said chamber and adjacent to said material inlet for igniting the inflammable organic liquid while on said material, means for maintaining burning of said liquid including said combustion air inlet means, and having at said other end of said chamber an outlet for dried material and transporting means for transporting the material through the chamber, said transport means being disposed approximate to said material outlet and being operably connected to said burning chamber, and said apparatus including a second heat treating chamber into which the dried material is fed, the heat being provided in the second chamber by hot combustion gases from the first chamber, said second chamber including transport means for transporting the dried material through said chamber.

7. The apparatus of claim 6 which the transport means comprises a perforated drum and the drum is disposed in the second heating chamber separate from the burning chamber and the second chamber has an inlet and outlet means for the material and for hot combustion gases from the burning chamber.

8. The apparatus of claim 6 wherein the burning chamber is vertically disposed, the inlet for the material and ignition means are at the lower end and the outer for the hot combustion gases and transport means are at the upper end.

9. The apparatus of claim 6 which the second chamber includes an inlet and outlet for the material and the second chamber transport means consists of a continuous conveyor belt means for transporting said material from the inlet to the outlet means.

10. The apparatus of claim 6 in which the second chamber includes inlet and outlet means for the material and the second chamber transport means consist of at least one perforated drum, which drum is operably associated with a drive means, causing the drum to rotate and draw said material from the inlet to the outlet.

11. The apparatus of claim 6 in which there is disposed outside of the burning chamber and before the burning chamber inlet means, cooling means which consist of a liquid impregnating cooling bath through which said material passes prior to being fed to the inlet, said cooling bath cooling the inflammable organic liquid and the material to a temperature below the ignition temperature of the inflammable organic liquid.

12. The apparatus of claim 6 in which there is disposed outside of the burning chamber and before the burning chamber inlet means, cooling means which consists of a cooling drum which drum is brought into contact with the material prior to the material being fed to the inlet, whereby the inflammable organic liquid and the material are cooled to a temperature below the ignition temperature of the inflammable organic liquid.

13. An apparatus for drying a fibrous material containing an inflammable organic liquid by igniting and burning the liquid from the material without damaging the material, comprising a burning chamber having two opposing walls, two lateral walls and two end walls, one of said end walls having an inlet and an outlet for the material to be dried,combustion air inlet means disposed approximate to the material inlet means disposed outside of the burning chamber and approximate to the material inlet and operably connected to said chamber for providing on the material an inflammable organic liquid, an ignition means mounted in said chamber adjacent to said material inlet for igniting the inflammable organic liquid while on said material, means for maintaining burning of said liquid including said combustion air inlet means, the other of said end walls having an outlet means for hot combustion gases, said burning chamber at the end adjacent to the material inlet and outlet having combustion air inlet means, and there being rotatably mounted within said burning chamber a drum operably connected to said chamber for transporting said material through said chamber.

14. The apparatus of claim 13 wherein suction means are disposed outside of the burning chamber and adjacent to the material inlet and operably connected to said chamber to remove inflammable organic liquid vapors from the material before the material enters said chamber.

15. The apparatus of clain 13 comprising cooling means disposed approximate to and outside of the inlet means to said burning chamber and operably connected to said chamber for maintaining the inflammable organic liquid prior to entering the burning chamber at a temperature below the ignition temperature of the inflammable organic liquid.

16. The apparatus of claim 13 including control means mounted in the burning chamber and disposed adjacent to and spaced along the material to be dried and operably connected to said chamber for controlling the ignition means, burning flame, speed of the material and safety devices.

17. The apparatus of claim 13 including heating means mounted in the burning chamber and disposed approximate to and spaced along the material to be dried and operably connected to said chamber for heating the inflammable organic liquid to a temperature above its ignition temperature.

18. The apparatus of claim 13 including flame control means mounted in the burning chamber and disposed adjacent to and spaced along the material to be dried and operably connected to said chamber wherein said flame control means comprise means for supplying air to the combustion flame.

19. The apparatus of claim 13 including flame control means mounted in the burning chamber and disposed adjacent to and spaced along the material to be dried and operably connected to said chamber wherein said flame control means comprise air supply nozzles and the direction of the nozzles and the amount of air supplied to the flame through the nozzles and capable of being varied.

20. The apparatus of claim 13 including safety means mounted in the burning chamber and disposed approximate to the material to be dried and operably connected to said chamber for supplying a non-combustible gas capable of extinguishing burning organic liquid.

21. The apparatus of claim 13 including safety means mounted on said burning chamber and operably connected to said chamber for extinguishing inflammable organic liquid on said material comprising means for closing off the supply of combustion air to said chamber.

22. The apparatus of claim 13 wherein the transport means comprises a perforated drum rotatably mounted in the burning chamber, the material to be dried is in contact with the drum and drive means is provided for rotating the drum and transporting the material through said chamber.

23. The apparatus of claim 13 wherein said material comprises a textile material.

24. The apparatus of claim 13 wherein combustion air is supplied to only one side of said material and drum and burning off the inflammable organic liquid is from one side only.

25. The apparatus of claim 13 wherein said drum is closed.

26. The apparatus of claim 13 wherein said drum is perforated.

27. The apparatus of claim 26 comprising mans for supplying hot air to the interior of the perforated drum and for blowing said hot air through the drum and material being dried.

28. An apparatus for drying a material containing an inflammable organic liquid by igniting and burning the liquid from the material without damaging the material, comprising a burning chamber having two opposing walls, two lateral walls and two end walls, one of said end walls having therein an inlet for the material to be dried, the other of said end walls having an outlet for hot combustion gases, means disposed outside of the burning chamber and approximate to the material inlet for providing on the material a burnable organic liquid, cooling means disposed outside of the burning chamber and approximate to the material inlet and operably connected to said burning chamber to maintain the burnable organic liquid and the material, prior to entering the burning chamber, at a temperature below the ignition temperature of the burnable organic liquid, ignition means being mounted within said chamber and adjacent to said material inlet for igniting the inflammable organic liquid, one of said end walls having therein an outlet for dried material, transport means for transporting the material through said chamber, said transport means being disposed approximate to said material outlet and being operably connected to said burning chamber.

29. The apparatus of claim 28 wherein suction means are disposed outside of the burning chamber and adjacent to the material inlet and are operably connected to said burning chamber to remove burnable organic liquid vapors from the material before the material enters the burning chamber.

30. An apparatus for drying a fibrous material containing an inflammable organic liquid by igniting and burning the liquid from the material without damaging the material, comprising a burning chamber having two opposing walls, two lateral walls and two end walls, one of said end walls having an inlet and an outlet for the material to be dried, means disposed outside of the burning chamber and approximate to the material inlet for providing on the material a burning organic liquid, cooling means disposed outside of the burning chamber and approximate to the material inlet and operably connected to said burning chamber to maintain the burnable organic liquid and the material, prior to entering the burning chamber, at a temperature below the ignition temperature of the burnable organic liquid, an ignition means mounted in said chamber adjacent to said material inlet for igniting the inflammable organic liquid, the other of said end walls having an outlet means for hot combustion gases, said burning chamber at the end adjacent to the material inlet and outlet having combustion air inlet means, and there being rotatably mounted within said burning chamber a drum operably connected to said chamber for transporting said material through said chamber.

31. The apparatus of claim 30 wherein suction means are disposed outside of the burning chamber and adjacent to the material inlet and operably connected to said chamber to remove inflammable organic liquid vapors from the material before the material enters said chamber.

32. The apparatus of claim 30 including safety means mounted in the burning chamber and disposed approximate to the material to be dried and operably connected to said chamber for supplying a non-combustible gas capable of extinguishing burning organic liquid.

33. The apparatus of claim 30 wherein the transport means comprises a perforated drum rotatably mounted in the burning chamber, the material to be dried is in contact with the drum and means is provided for rotating the drum and transporting the material through said chamber.

34. The apparatus of claim 30 wherein said material is a textile material and the organic liquid is selected from the group consisting of methanol and mixtures of methanol and water.

* * * * *

UNITED STATES PATENT AND TRADEMARK OFFICE

CERTIFICATE OF CORRECTION

PATENT NO. : 3,984,198

DATED : October 5, 1976

INVENTOR(S) : Birke et al.

It is certified that error appears in the above-identified patent and that said Letters Patent are hereby corrected as shown below:

In the Heading, Item [30], line 3, replace "February 23, 1972" by --September 23, 1972--.

Signed and Sealed this

Fourth Day of January 1977

[SEAL]

*Attest:*

RUTH C. MASON
*Attesting Officer*

C. MARSHALL DANN
*Commissioner of Patents and Trademarks*